US006896195B2

(12) United States Patent
Kato et al.

(10) Patent No.: US 6,896,195 B2
(45) Date of Patent: May 24, 2005

(54) ELECTROMAGNETIC FUEL INJECTION VALVE AND METHOD FOR MANUFACTURING SAME

(75) Inventors: Yukinori Kato, Obu (JP); Hideaki Nishibu, Obu (JP); Hikaru Kikuta, Obu (JP)

(73) Assignee: Aisan Kogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 10/409,373

(22) Filed: Apr. 8, 2003

(65) Prior Publication Data

US 2003/0189113 A1 Oct. 9, 2003

(30) Foreign Application Priority Data

Apr. 9, 2002 (JP) ..... 2002-142225

(51) Int. Cl.[7] ..... B05B 1/30
(52) U.S. Cl. ..... 239/5; 239/585.1; 239/533.2
(58) Field of Search ..... 239/585.1, 585.5, 239/533.2, 5

(56) References Cited

U.S. PATENT DOCUMENTS 4,231,525 A * 11/1980 Palma ..... 239/585.2
4,527,744 A * 7/1985 Hafner et al. ..... 239/585.3
4,796,855 A * 1/1989 Sofianek ..... 251/129.15
4,932,251 A * 6/1990 Okada et al. ..... 72/334
5,039,568 A * 8/1991 Taniguchi et al. ..... 428/141

FOREIGN PATENT DOCUMENTS

JP 8506876 7/1996
JP 11247739 9/1999

OTHER PUBLICATIONS

*English abstract and computer translation are enclosed.

* cited by examiner

*Primary Examiner*—Dinh Q. Nguyen
(74) *Attorney, Agent, or Firm*—Baker Botts LLP

(57) ABSTRACT

An electromagnetic fuel injection valve wherein it is possible to prevent undesired adhesion between the respective abutting surfaces of an armature and a stationary core as well as to ensure the required wear resistance for the abutting surfaces and wherein the amount of lift of the valving element is unlikely to change is provided. After rough surfaces like satin-finished surfaces have been farmed on the abutting surfaces by shot peening, the rough surfaces are flattened by spotting. Therefore, the abutting surfaces can easily separate from each other without likelihood of adhering so closely that is difficult for them to separate from each other. Also, the amount of lift of the valving element is unlikely to change. Accordingly, the amount of fuel injected by the fuel injection valve is unlikely to change with passage of time. Thus, stable fuel supply can be performed.

2 Claims, 3 Drawing Sheets

ELECTROMAGNETIC FUEL INJECTION VALVE AND METHOD FOR MANUFACTURING SAME

BACKGROUND OF THE INVENTION

1. Field of the Invention

The present invention relates to an electromagnetic fuel injection valve for use in an internal-combustion engine. More particularly, the present invention relates to an electromagnetic fuel injection valve wherein it is possible to prevent undesired adhesion between the respective abutting surfaces of an armature and a stationary core as well as to improve wear resistance of the two abutting surfaces.

2. Discussion of Related Art

A typical electromagnetic fuel injection valve has an electromagnetic coil and a valving element secured to an armature. In operation, the electromagnetic coil is excited to lift the armature. When the armature thus lifted abuts against a stationary core, a gap is created between the valving element and the associated valve seat, thereby allowing fuel to be injected through the gap. Accordingly, it is necessary to ensure wear resistance for the respective abutting surfaces of the armature and the stationary core and to eliminate or minimize residual magnetism between the abutting surfaces. It has already been known that at least one of the two abutting surfaces is plated with chromium or nickel to ensure the required wear resistance and to eliminate or minimize the residual magnetism (for example, see Published Japanese Translation of PCT International Publication No. Hei 8-506876).

SUMMARY OF THE INVENTION

However, a complicated operation is needed to plate the abutting surface of the armature or the stationary core as stated above. In addition, an extra number of man-hours is needed for the plating operation. Hence, costs increase unavoidably. If the plated abutting surfaces are mirror finished surfaces, they may adhere, when abutting, so closely that it is difficult for them to separate from each other. This causes a delay in the valve closing operation of the valving element. Under these circumstances, a technique wherein the abutting surfaces are previously formed into rough surfaces like satin-finished surfaces by shot peening has already been disclosed as a method for solving the above-described problems [for example, see Japanese Patent Application Unexamined Publication (KOKAI) No. Hei 11-247739]. With this technique, however, the abutting surfaces abut against each other at the tips of asperities of the rough surfaces. Therefore, the tips of the asperities may be worn away in a short period of time by repeated contact, resulting in an increase in the amount of lift of the valving element. This may cause the fuel injection quantity to increase undesirably.

Accordingly, an object of the present invention is to provide an electromagnetic fuel injection valve wherein it is possible to prevent undesired adhesion between the abutting surfaces as well as to ensure the required wear resistance for the abutting surfaces and wherein the amount of lift of the valving element is unlikely to change.

To attain the above-described object, the present invention is applied to an electromagnetic fuel injection valve wherein an armature having a valving element secured thereto is lifted by excitation of a coil so that an abutting surface of the armature abuts against an abutting surface of a stationary core, thereby allowing fuel to be injected through an injection port provided downstream of a valve seat. The abutting surface of the armature and the abutting surface of the stationary core have respective rough surfaces like satin-finished surfaces formed by shot peening. According to the present invention, the rough surfaces are flattened by spotting.

Thus, according to the present invention, after rough surfaces like satin-finished surfaces have been formed on the respective abutting surfaces of the armature and the stationary core by shot peening, the rough surfaces are flattened by spotting. Therefore, the abutting surfaces can easily separate from each other without likelihood of adhering so closely that it is difficult for them to separate from each other. In addition, because the tips of asperities of the rough surfaces are flattened by spotting, the tips of the asperities will not easily be worn away by repeated contact, and the amount of lift of the valving element is unlikely to change.

The present invention offers the following advantageous effects. According to the present invention, after rough surfaces like satin-finished surfaces have been formed on the respective abutting surfaces of the armature and the stationary core by shot peening, the rough surfaces are flattened by spotting. Therefore, the abutting surfaces can easily separate from each other without likelihood of adhering so closely that it is difficult for them to separate from each other. In addition, because the tips of asperities of the rough surfaces are flattened by spotting, the tips of the asperities will not easily be worn away by repeated contact, and the amount of lift of the valving element is unlikely to change. Accordingly, the amount of fuel injected by the fuel injection valve is unlikely to change with passage of time. Thus, stable fuel supply can be performed.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claim.

DESCRIPTION OF THE PREFERRED EMBODIMENTS

Figure 1:
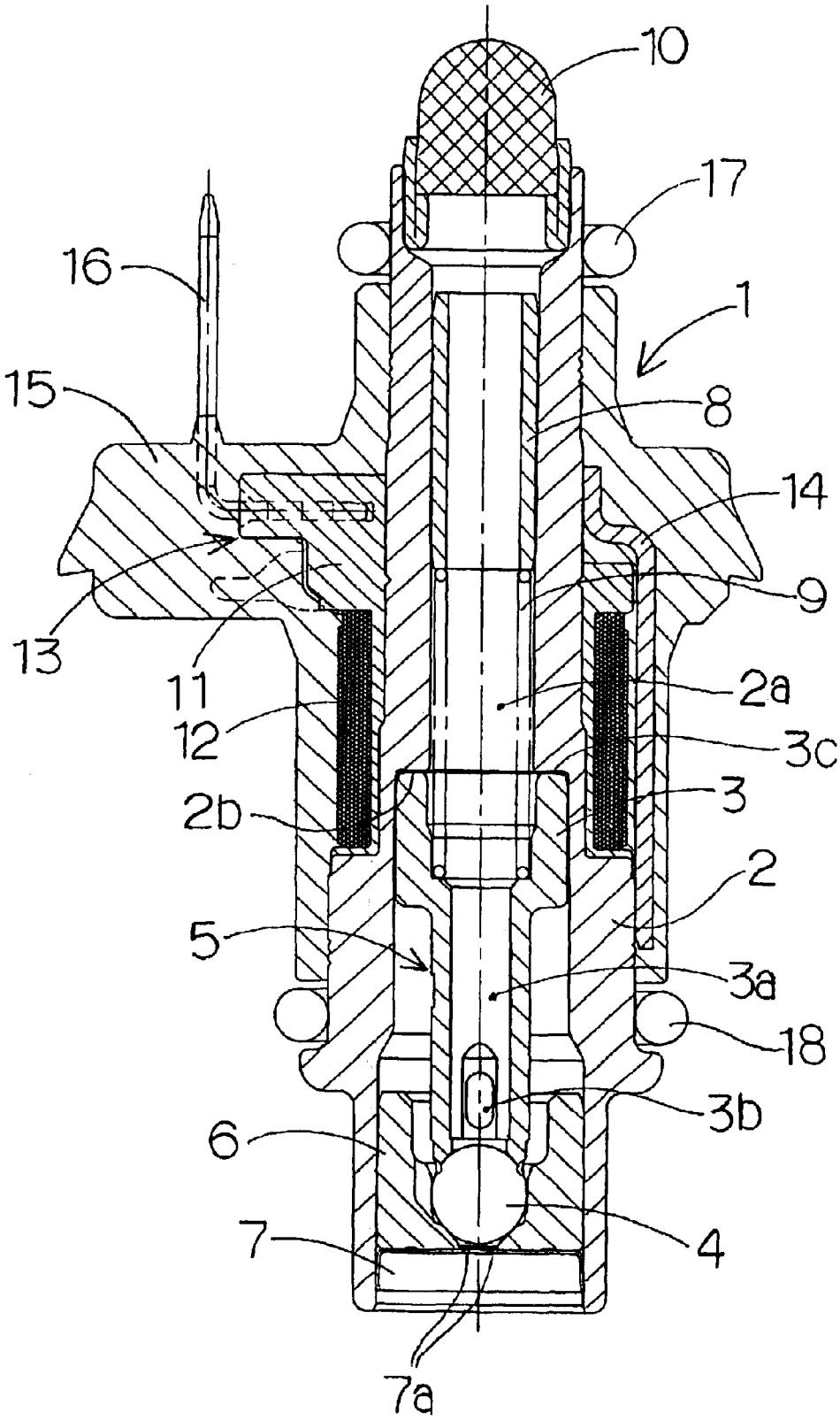
FIG. 1 is a longitudinal sectional view of a fuel injection valve according to an embodiment of the present invention.

A preferred embodiment of the present invention will be described below with reference to the accompanying drawings. In FIG. 1, a fuel injection valve 1 includes a stationary core 2. The stationary core 2 has a fuel passage 2*a* provided in the center thereof. An armature (moving core) 3 is slidably disposed in the fuel passage 2*a*. A fuel passage 3*a* is provided in the center of the armature 3 to pass fuel. A ball valve (valving element) 4 is secured to the distal end of the armature 3, for example, by welding to constitute a moving valve 5. A communicating hole 3*b* is provided in the armature 3 near the ball valve 4 to allow fuel to flow to the outside from the fuel passage 3*a*. A nozzle 7 is secured to the lower opening of the stationary core 2 by press fitting or welding. The nozzle 7 has a valve seat 6 and an injection port 7*a*. The moving valve 5 is arranged to move between the valve seat 6 and an abutting surface 2*b* of the stationary core 2 with an appropriate lift (gap). A cylindrical sleeve 8 is press-fit into the rear end portion of the fuel passage 2*a*. The forward end of the sleeve 8 retains the rear end of a spring 9 for pressing the moving valve 5 against the valve seat 6.

A filter 10 is press-fit into the upper opening of the stationary core 2. A coil subassembly 13 is fitted on the outer periphery of the stationary core 2. The coil subassembly 13 comprises a bobbin 11 and a coil 12 wound around the bobbin 11. The coil subassembly 13 is integrally resin-molded with a synthetic resin housing 15 with a yoke 14 provided therebetween. One end of the coil 12 is connected to a terminal 16. The other end of the coil 12 is grounded. Thus, an electric signal is input through the terminal 16. The upper end portion of the fuel injection valve 1 is connected to a delivery pipe through an O-ring 17. The lower end portion of the fuel injection valve 1 is connected to an intake manifold through an O-ring 18. Fuel flowing into the fuel injection valve 1 through the filter 10 is injected through the injection port 7*a* when the moving valve 5 is pushed up in response to the energization of the coil 12. The abutting surface 2*b* of the stationary core 2 and the abutting surface 3*c* of the armature 3 have been formed with plateau surfaces, respectively. That is, the abutting surfaces 2*b* and 3*c* are subjected to shot peening process to form rough surfaces like satin-finished surfaces. Thereafter, the peaks of the rough surfaces are flattened by spotting.

Figure 2:
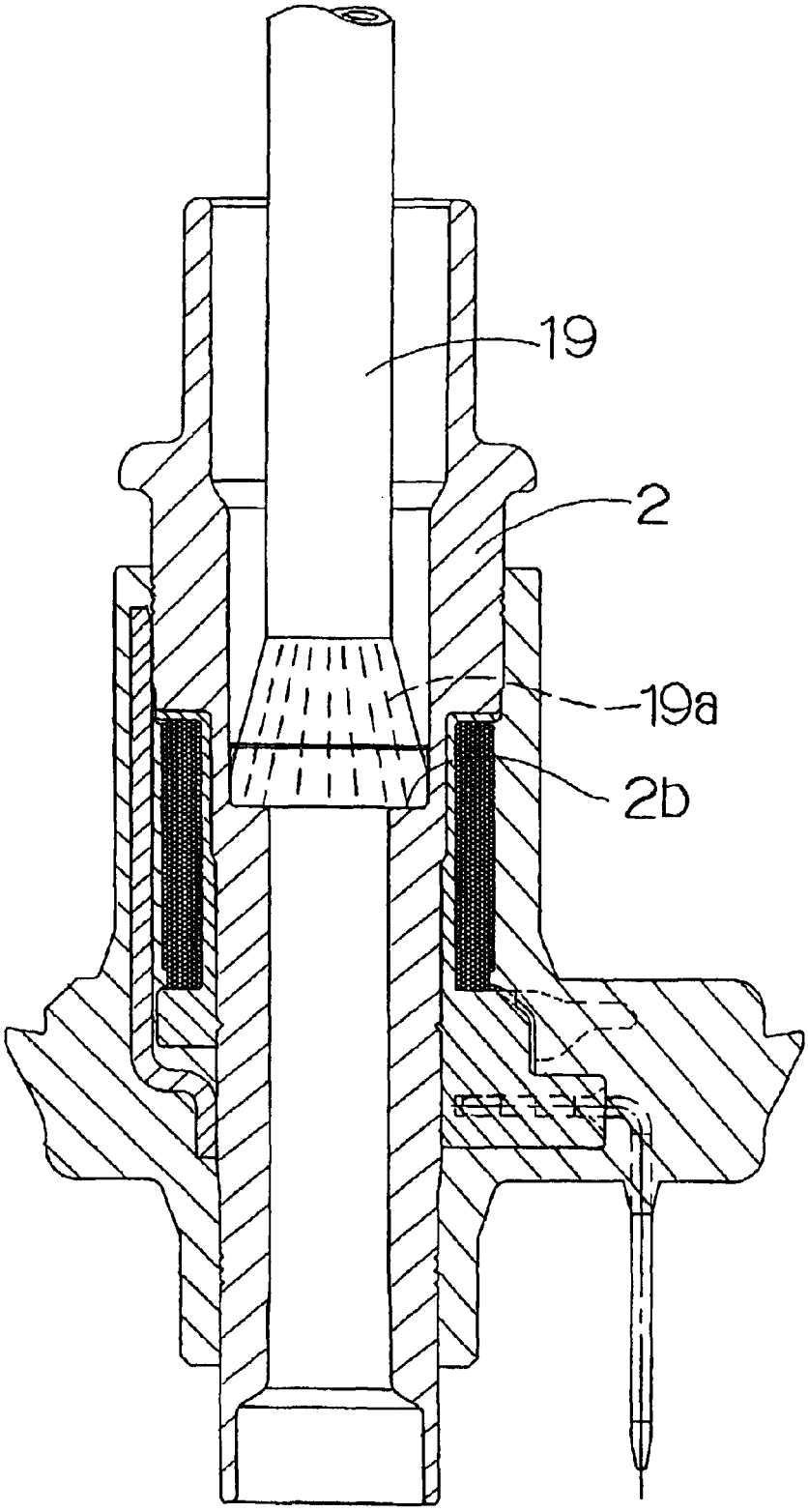
FIG. 2 is a longitudinal sectional view of the fuel injection valve according to the present invention during shot peening process.

Next, the formation of the abutting surface of the stationary core according to this embodiment will be described with reference to the drawings. In FIG. 2, the stationary core 2 is held in a direction in which the abutting surface 2*b* faces upward. An injection nozzle 19 for shot peening is inserted into the stationary core 2 from above. The tip of the injection nozzle 19 is positioned so that a shot 19*a* will be applied to the whole abutting surface 2*b* in view of the relationship between the divergence angle of the shot 19*a* and the position of the injection nozzle tip. By the shot peening process, the hardness of the abutting surface 2*b* becomes HV 300 to 400, and a rough surface like a satin-finished surface with a surface roughness of about 6 $\mu$m (Rz) is formed thereon. It should be noted that the surface roughness of the body material before the shot peening process is about 2 $\mu$m (Rz), and the hardness thereof is approximately HV 150.

Figure 3:
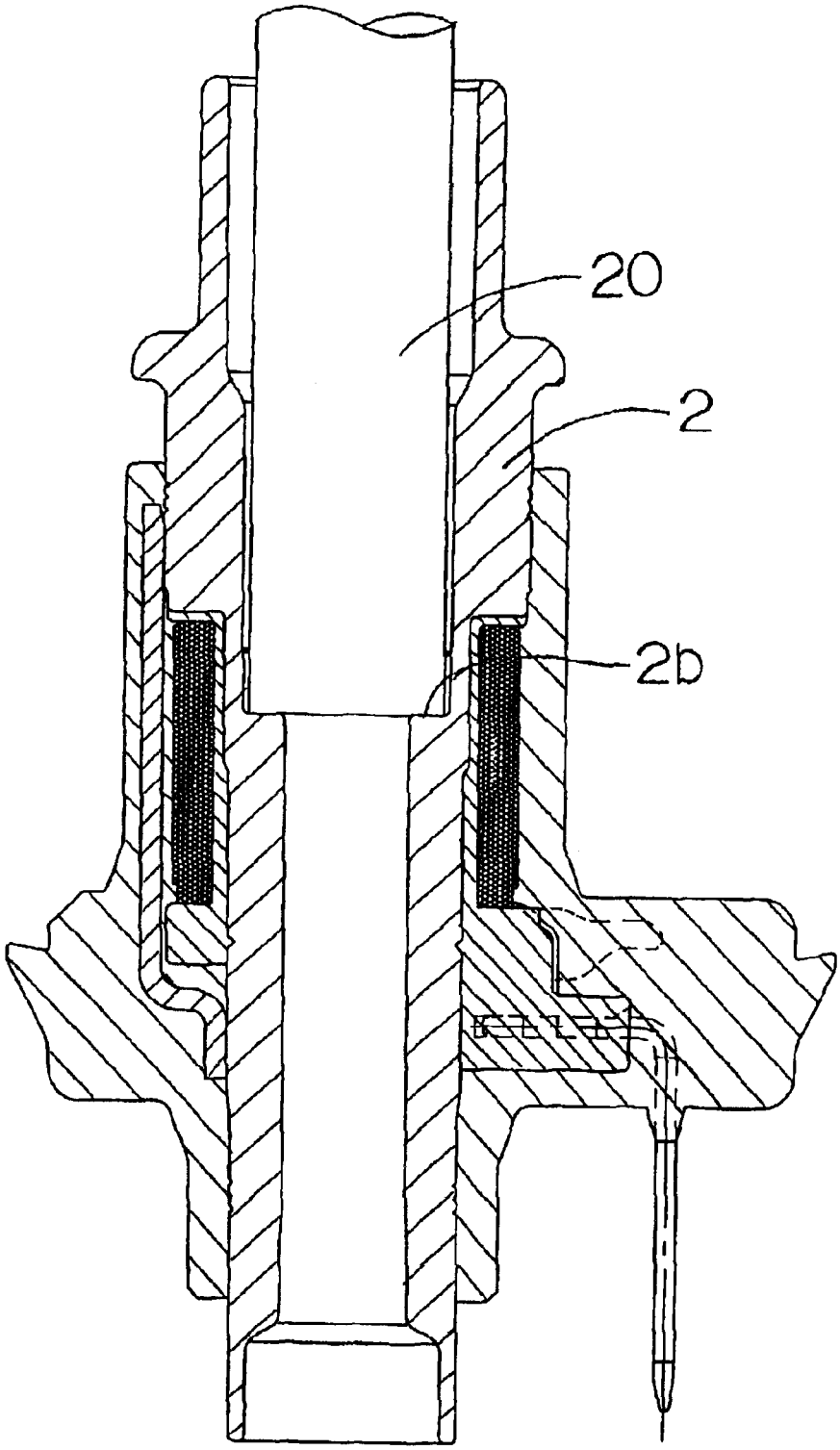
FIG. 3 is a longitudinal sectional view of the fuel injection valve according to the present invention during spotting process.

Next, the abutting surface 2*b* formed into a rough surface like a satin-finished surface is subjected to spotting by flattening process. In FIG. 3, the stationary core 2 is held in a direction in which the abutting surface 2*b* faces upward. A punch 20 for flattening is inserted into the stationary core 2 from above. Flattening is carried out with a pressure of about 2 kN. The surface roughness after the flattening process is about 3 $\mu$m (Rz). It should be noted that shot peening and spotting for the abutting surface 3*c* of the armature 3 are carried out by the same methods as the above. Therefore, a description thereof is omitted.

A dynamic flow change rate measuring test was performed on three samples, i.e. a conventional hard chrome-plated product (sample A), a product subjected to only the shot peening treatment (sample B), and a product of the present invention subjected to both the shot peening treatment and spotting (sample C). The results of the measurement 80 hours after the initiation of the test were as follows.

| Sample | Rate of change of flow |
|---|---|
| Sample A | not more than +4% |
| Sample B | not less than +10% |
| Sample C | not more than +4% |

Thus, the product of the present invention (sample C) shows a favorable result.

It should be noted that the present invention is not necessarily limited to the foregoing embodiment but can be modified in a variety of ways without departing from the gist of the present invention.

What is claimed is:

1. An electromagnetic fuel injection valve wherein an armature having a valving element secured thereto is lifted by excitation of a coil so that an abutting surface of the armature abuts against an abutting surface of a stationary core, thereby allowing fuel to be injected through an injection port provided downstream of a valve seat, the abutting surface of said armature and the abutting surface of said stationary core having respective rough surfaces like satin-finished surfaces formed by shot peening, wherein said rough surfaces have been flattened by spotting.

2. A method for manufacturing an electromagnetic fuel injection valve, the method comprising:

providing a valving element, providing an armature adapted to be secured thereto, the armature being adapted to be lifted by excitation of a coil so that an abutting surface of the armature abuts against an abutting surface of a stationary core, thereby allowing fuel to be injected through an injection port provided downstream of a valve seat, shot peening the abutting surface of said armature and the abutting surface of said stationary core to form respective rough surfaces like satin-finished surfaces, and flattening said rough surfaces by spotting.

* * * * *